United States Patent [19]

Hall et al.

[11] 4,147,274

[45] Apr. 3, 1979

[54] FLOATING ROOF TANK SEAL

[75] Inventors: William E. Hall, Lakewood; James G. Record, Anaheim, both of Calif.

[73] Assignee: Shell Oil Company, Houston, Tex.

[21] Appl. No.: 905,263

[22] Filed: May 12, 1978

[51] Int. Cl.[2] ..... B65D 87/207; F16J 15/32

[52] U.S. Cl. ..... 220/226; 277/165; 277/228; 277/229

[58] Field of Search ..... 277/34.3, 165, 181, 277/228, 229; 220/221, 222, 224, 225, 226

[56] References Cited

U.S. PATENT DOCUMENTS

| | | | |
|---|---|---|---|
| 3,112,933 | 12/1963 | Merkel | 277/228 X |
| 3,125,346 | 3/1964 | Poltorak | 220/226 X |
| 4,099,643 | 7/1978 | Wardwell et al. | 220/222 |

FOREIGN PATENT DOCUMENTS

| | | | |
|---|---|---|---|
| 1150462 | 8/1957 | France | 277/229 |
| 1541092 | 8/1968 | France | 220/225 |
| 516530 | 1/1931 | Fed. Rep. of Germany | 220/224 |
| 2512726 | 9/1976 | Fed. Rep. of Germany | 220/226 |
| 882189 | 11/1961 | United Kingdom | 220/226 |
| 883770 | 12/1961 | United Kingdom | 220/225 |

*Primary Examiner*—Robert S. Ward, Jr.

[57] ABSTRACT

A rim seal is provided for a floating roof tank to fill the space between the floating roof and circumferential wall of the tank. The seal is a compressible toroid of approximately the diameter of the tank and has a cross-sectional diameter greater than the largest opening between the floating roof and the circumferential wall or an existing seal and the circumferential wall. An inner tube is provided which encapsulates the toroid; an outer tube is provided which is elastic and encapsulates the inner tube. Slits in the outer tube adjacent to the circumferential wall are disposed substantially circumferentially with respect to the toroid.

9 Claims, 2 Drawing Figures

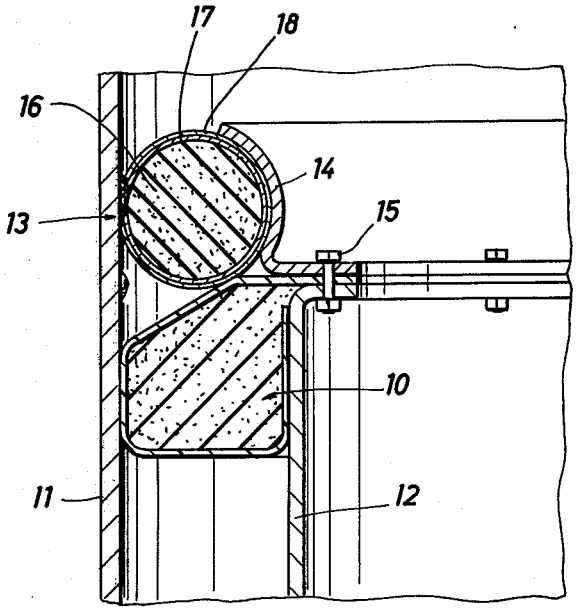
FIG. 1
FIG. 2
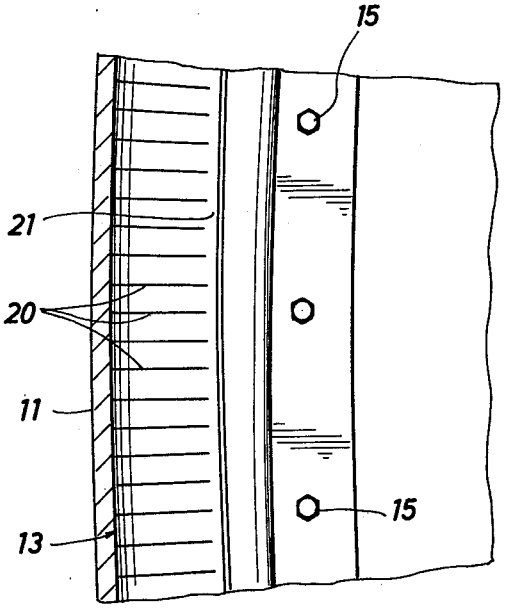

FLOATING ROOF TANK SEAL

BACKGROUND OF THE INVENTION

Air pollution regulations for floating roof tanks are becoming increasingly stringent. The need for an improved circumferential seal for such tanks is real and urgent for the entire industry. A tank is deemed to violate regulations in some areas if the gap between the tank wall and the roof seal exceeds ⅛-inch for an accumulated length amounting to more than 5 percent of the tank circumference.

A primary problem with sealing the space between a floating roof and a circumferential wall of the tank resides in the presence of protuberances in the wall such as rivets, welds and the like. As the seal rises up and down with the floating roof, such protuberances cause gaps between the seal and the tank wall which allows the escape of pollutant vapors from the tank.

SUMMARY OF THE INVENTION

In accordance with the present invention, a rim seal for a floating roof tank is provided to seal the space between the floating roof and circumferential wall of the tank, comprising, a compressible toroid of approximately the diameter of the tank and having a cross-sectional diameter greater than the largest opening between the floating roof and the circumferential wall or an existing seal and the circumferential wall, an inner tube which substantially encapsulates the toroid, an outer tube which is elastic and substantially encapsulates the inner tube, slits in the outer tube adjacent to the circumferential wall and disposed substantially circumferentially with respect to the toroid, and means for attaching the rim seal to the floating roof.

DESCRIPTION OF THE DRAWINGS

FIG. 1 is a cross-sectional view of a conventional seal below a seal of the present invention.

FIG. 2 is a side elevational view of the seal of the present invention showing details of the slitting configuration.

DESCRIPTION OF PREFERRED EMBODIMENTS

Floating roof tanks require a rim seal between the floating roof and the tank wall in order to comply with regulatory pollution control requirements. In accordance with the present invention a slitted tube-type seal is provided which has sufficient flexibility to fit closely to the wall as the floating roof travels up and down, even in the presence of rivets, welds and plate overlaps.

Depending upon regulatory requirements, the seal may be used as a sole sealing means or in combination with an existing seal 10 as shown in the drawings. Seal 10 fits between a tank wall 11 and floating roof 12 in the conventional manner. The slitted floating roof seal 13 of the present invention is located above the conventional seal, if any, and has a cross-sectional diameter wider than the largest gap between the floating roof 12 or seal 10 and the tank wall 11. The seal 13 is held in place by a plate 14, curved to fit the seal, and bolted or otherwise attached to the tank roof by a bolt 15, which may also be utilized to hold seal 13 in place. The core of the toroidal seal of the present invention is a resilient material, preferably a reaction product of an isocyanate and a hydroxyl compound such as polyurethane foam. The inner flexible foam core is encapsulated by an inner tube, preferably a two-ply super-duty fabric impregnated with a copolymer of acrylonitrile and butadiene such as Buna-N-rubber of about 0.032" thickness.

As shown in FIG. 2 the outer tube is provided with slits, preferably about ¼-inch to about ½-inch apart. Because both inner and outer tubes are quite resilient and flexible, the slits easily conform to the shape of the rivets, welds, plate overlaps and the like as the seal slides up and down against tank wall 11. This, as noted, nearly eliminates any gaps between the floating rooftop 12 and tank wall 11. Such slits 20 are desirably about 7 to 9 inches long depending upon the diameter of the rim seal. Adjacent to either end of the slits may be provided some sort of reinforcement 21 to prevent the slits from lengthening. Preferably, the slits extend circumferentially of the rim seal and vertically with respect to the tank wall. The distance between the slits of course may be varied in accordance with the distance between protuberances on the inside of the circumferential tank walls. Generally, it is preferable to space the slits closely to accommodate any spacing of protuberances on the tank wall.

I claim as my invention:

1. A rim seal for a floating roof tank to seal the space between the floating roof and circumferential wall of the tank, comprising, a compressible toroid of approximately the diameter of the tank and having a cross-sectional diameter greater than the largest opening between the floating roof and the circumferential wall or an existing seal and the circumferential wall, an inner tube which encapsulates the toroid, an outer tube which is elastic and encapsulates the inner tube, slits in the outer tube adjacent the circumferential wall and disposed substantially circumferentially with respect to the toroid, and means for attaching the rim seal to the floating roof.

2. The seal of claim 1 wherein the distance between the slits is from about ¼ inch to about ½ inch.

3. The seal of claim 1 wherein the length of the slits is from about 7 inches to about 9 inches.

4. The seal of claim 1 wherein the toroid is polyurethane foam.

5. The seal of claim 1 wherein the inner tube is Buna-N-rubber.

6. The seal of claim 1 wherein the outer tube is urethane-nylon fabric.

7. The seal of claim 1 wherein the distance between the slits varies in accordance with the distance between protuberances on the inside of the circumferential wall.

8. The seal of claim 7 wherein the protuberances are rivets, plate overlaps, or welds.

9. The seal of claim 1 wherein the inner tube is elastic.

* * * * *